US008579779B2

(12) United States Patent
Totani

(10) Patent No.: US 8,579,779 B2
(45) Date of Patent: Nov. 12, 2013

(54) PLASTIC BAG MAKING APPARATUS

(75) Inventor: Mikio Totani, Kyoto (JP)

(73) Assignee: Totani Corporation, Kyoto (JP)

( * ) Notice: Subject to any disclaimer, the term of this patent is extended or adjusted under 35 U.S.C. 154(b) by 580 days.

(21) Appl. No.: 12/836,007

(22) Filed: Jul. 14, 2010

(65) Prior Publication Data

US 2011/0015052 A1 Jan. 20, 2011

(30) Foreign Application Priority Data

Jul. 17, 2009 (JP) ..... 2009-168859
Jun. 11, 2010 (JP) ..... 2010-133605

(51) Int. Cl.
*B65B 61/14* (2006.01)
*B31B 1/64* (2006.01)

(52) U.S. Cl.
USPC ..... 493/189; 53/134.1

(58) Field of Classification Search
USPC ..... 493/189, 186, 196, 210, 214, 379; 53/413, 134.1
See application file for complete search history.

(56) References Cited

U.S. PATENT DOCUMENTS

| | | | |
|---|---|---|---|
| 5,112,138 | A | 5/1992 | Peppiatt |
| 5,158,368 | A | 10/1992 | Lichtwardt |
| 6,092,933 | A | 7/2000 | Treu |
| 7,331,917 | B2 | 2/2008 | Totani |
| 2003/0185466 | A1 | 10/2003 | Edelman |

FOREIGN PATENT DOCUMENTS

| | | |
|---|---|---|
| EP | 1541332 | 6/2005 |
| GB | 2254065 | 9/1992 |
| JP | 46041722 | 9/1971 |
| JP | 4913503 | 6/1974 |
| JP | 2000-153849 | 6/2000 |
| JP | 2003-048260 | 2/2003 |
| JP | 2004-067149 | 3/2004 |
| JP | 2005-178843 | 7/2005 |
| WO | WO 00/58166 | 10/2000 |

*Primary Examiner* — Alexandra Elve
*Assistant Examiner* — John Paradiso
(74) *Attorney, Agent, or Firm* — Kirschstein, et al.

(57) ABSTRACT

The apparatus includes panel portions forming means by which two webs of panel material are opposed to and superposed on each other and fed longitudinally thereof, the panel portions being formed by the webs of panel material. The apparatus further includes side gusset portions forming means by which sheets of side gusset material are folded into halves and combined with and interposed between the webs of panel material to extend widthwise thereof, the side gusset portions being formed by the sheets of side gusset material. The apparatus further includes bottom gusset portion forming means by which a web of bottom gusset material is combined with the webs of panel material to extend longitudinally thereof, the bottom gusset portion being formed by the web of bottom gusset material with at least one bottom protrusion protruding from the bottom gusset portion. In addition, the apparatus includes option means by which the bottom protrusion is provided with a handle hole, zipper, opening or adhesive means.

12 Claims, 20 Drawing Sheets

A

B

PLASTIC BAG MAKING APPARATUS

TECHNICAL FIELD

The invention relates to an apparatus for successively making plastic bags.

BACKGROUND

There has heretofore been proposed a plastic bag including panel portions, side gusset portions and a bottom gusset portion, as disclosed in U.S. Pat. No. 7,331,917. The panel portions are formed by two sheets of panel material which are opposed to each other. The side gusset portions are formed by two sheets of side gusset material which are interposed between the sheets of panel material to extend along the opposite side edges of panel portions. The bottom gusset portion is formed by a sheet of bottom gusset material which is interposed between the sheets of panel material to extend along ones of the opposite end edges of panel portions. The plastic bag can therefore be enlarged by the side gusset portions to obtain an increased capacity. A flat bottom surface can be formed by the bottom gusset portion to make the plastic bag stand stably.

In addition to the side gusset portions and the bottom gusset portion, an additional bottom gusset portion may be formed by a sheet of additional bottom gusset material which is interposed between the webs of panel material to extend along the other end edges of panel portions, as disclosed in Japanese Patent Publication No. 4,108,846. In this case, the plastic bag can be shaped into a rectangular parallelepiped to have an appearance of box when being filled with content. A flat top surface is formed by the bottom gusset portion while a flat bottom surface is formed by the additional bottom gusset portion. The plastic bag is therefore high in efficiency of being filled. The plastic bags can be piled up conveniently.

The plastic bag of the U.S. patent or the Japanese Patent is therefore expected to be used widely in the future. In this connection, it is required to make the plastic bag have an added value. For example, the plastic bag is too heavy to carry it when being large and being filled with content. It is therefore required to make the plastic bag provided with a handle hole in position to carry the plastic bag by the handle hole.

It is also required to make the plastic bag provided with a zipper in position to open and close the plastic bag by the zipper. It is also required to make the plastic bag provided with an opening in position. It is also required to make the plastic bag provided with adhesive means to close the plastic bag.

It is therefore an object of the invention to provide a new and improved apparatus for successively making plastic bags each of which includes panel portions, side gusset portions and a bottom gusset portion.

Other object is to make the plastic bag have an added value.

SUMMARY OF THE INVENTION

According to the invention, the apparatus includes panel portions forming means by which two webs of panel material are opposed to and superposed on each other and fed longitudinally thereof, the panel portions being formed by the webs of panel material. The apparatus further includes side gusset portions forming means by which sheets of side gusset material are folded into halves and combined with and interposed between the webs of panel material to extend widthwise thereof, the side gusset portions being formed by the sheets of side gusset material. The apparatus further includes bottom gusset portion forming means by which a web of bottom gusset material is combined with the webs of panel material to extend longitudinally thereof, the bottom gusset portion being formed by the web of bottom gusset material with at least one bottom protrusion protruding from the bottom gusset portion. In addition, the apparatus includes option means by which the bottom protrusion is provided with a handle hole, zipper, opening or adhesive means.

In a preferred embodiment, the bottom protrusion is formed by one of the webs of panel material and the web of bottom gusset material extending beyond and protruding from the bottom gusset portion to be opposed to and superposed on each other.

The bottom protrusion may be formed by one of the webs of panel material or the web of bottom gusset material extending beyond and protruding from the bottom gusset portion.

The apparatus further includes panel material guide means by which one of the webs of panel material is guided to be folded along a longitudinal folded line when being fed to open the webs of panel material and form an open surface thereof. The web of bottom gusset material is superposed on the open surface.

The bottom gusset portion forming means comprises additional panel material guide means by which the other web of panel material is guided to be folded along a longitudinal folded line when being fed so that a folded portion can be formed in the other web of panel material. The web of bottom gusset material is formed by the folded portion and superposed on the open surface.

The bottom gusset portion forming means may comprise bottom gusset material supply means, by which the web of bottom gusset material is supplied to the webs of panel material and superposed on the open surface.

The webs of panel material are fed intermittently for a length.

The side gusset portions forming means comprises side gusset material supply means by which the sheets of side gusset material are supplied to the webs of panel material one by one whenever the webs of panel material are fed intermittently.

The apparatus further includes longitudinal seal means by which the webs of panel material and the web of bottom gusset material are heat sealed with each other longitudinally of the webs of panel material whenever the webs of panel material are fed intermittently.

The apparatus further includes cross seal means by which the webs of panel material and the sheet of side gusset material are heat sealed with each other widthwise of the webs of panel material whenever the webs of panel material are fed intermittently. The apparatus further includes a cutter by which the webs of panel material, the sheet of side gusset material and the web of bottom gusset material are cut widthwise of the webs of panel material whenever the webs of panel material are fed intermittently.

One of the webs of panel material is unfolded to close the webs of panel material by the panel material guide means after the web of bottom gusset material is superposed on the open surface. The web of bottom gusset material is folded into halves along a longitudinal folded line and interposed between the webs of panel material. The webs of panel material and the sheet of side gusset material are then heat sealed with each other widthwise of the webs of panel material under a condition of closing the webs of panel material. The webs of panel material, the sheet of side gusset material and the web of bottom gusset material are cut widthwise of the webs of panel material under the condition of closing the webs of panel material.

The webs of panel material and the sheet of side gusset material may be heat sealed with each other widthwise of the webs of panel material under a condition of opening the webs of panel material. The webs of panel material, the sheet of side gusset material and the web of bottom gusset material may be cut widthwise of the webs of panel material under the condition of opening the webs of panel material.

The bottom gusset portion forming means may comprise bottom gusset material supply means by which the web of bottom gusset material is folded into halves and supplied to and interposed between the webs of panel material.

BEST MODE TO CARRY OUT THE INVENTION

Figure 1:
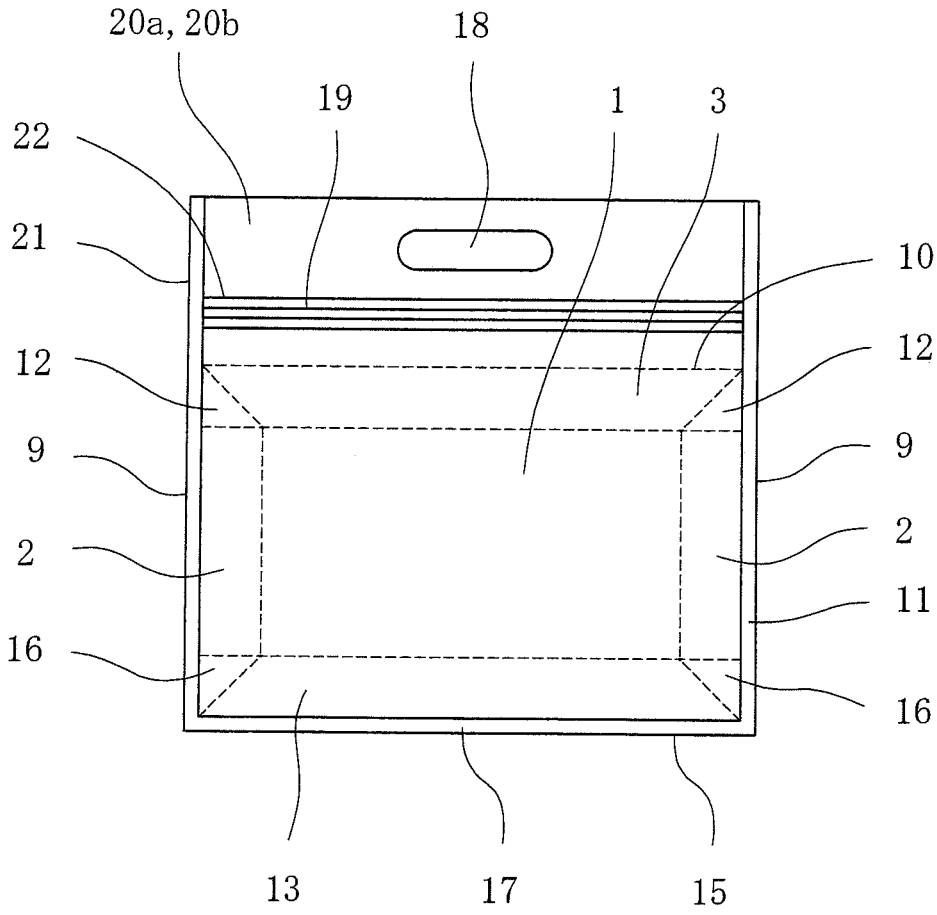
FIG. 1 is an elevational view of a plastic bag according to the invention.
Figure 2:
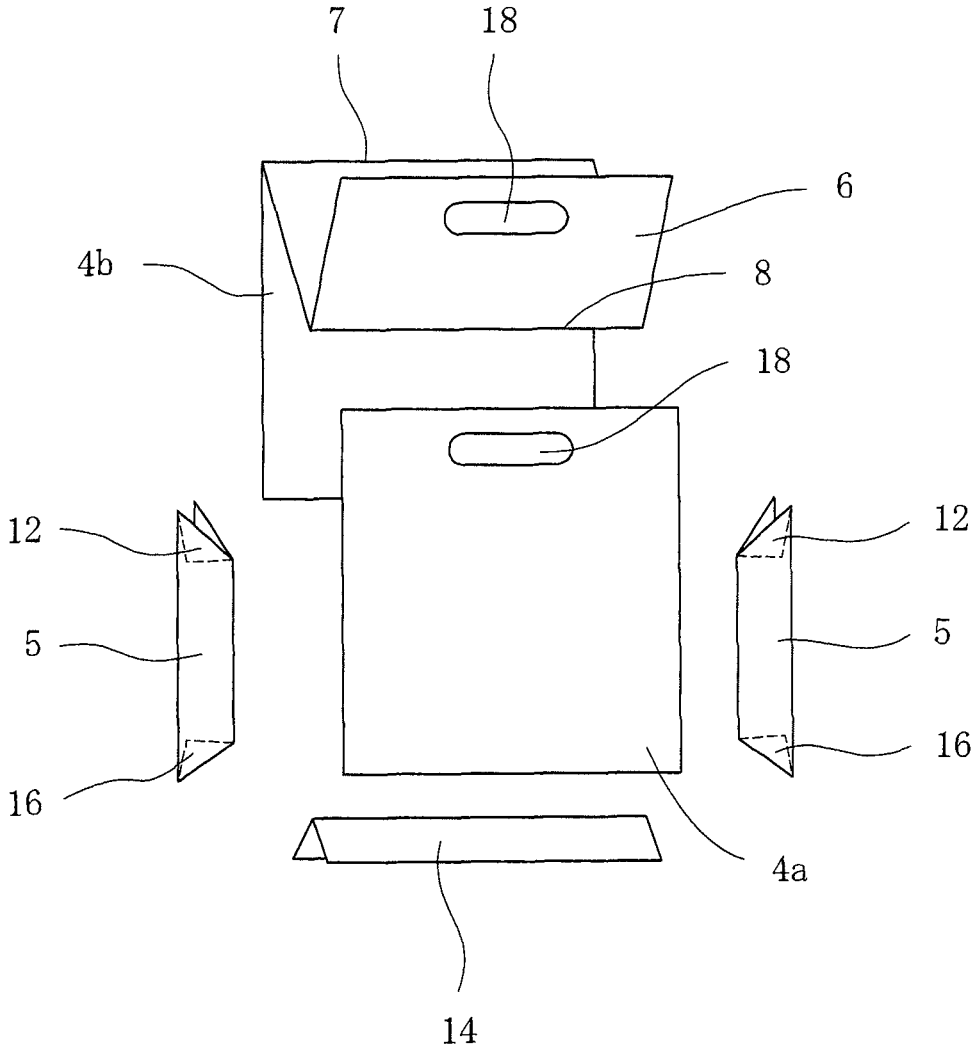
FIG. 2 is an exploded and perspective view of the plastic bag of FIG. 1.
Figure 3:
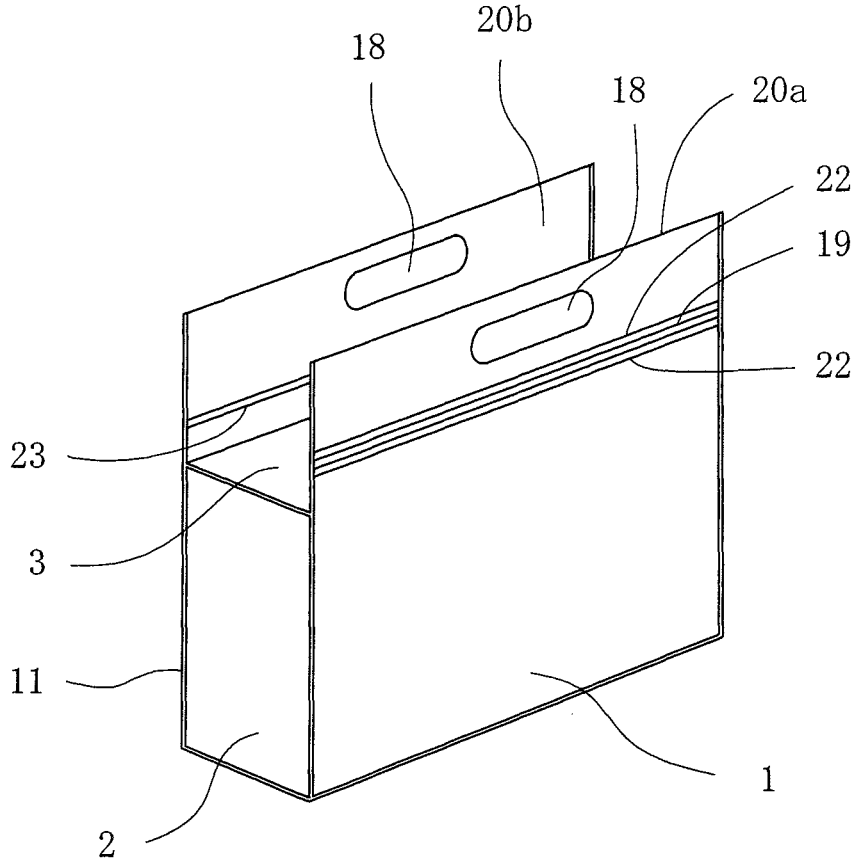
FIG. 3 is a perspective view of the plastic bag of FIG. 1 when being filled with content.

Turning now to the drawings, FIG. 1 illustrates a plastic bag according to the invention. The plastic bag includes panel portions 1, side gusset portions 2 and a bottom gusset portion 3. The panel portions 1 are formed by two sheets of panel material 4*a* and 4*b* which are opposed to each other, as shown in FIGS. 2 and 3. The side gusset portions 2 are formed by two sheets of side gusset material 5 which are folded into halves, superposed into two layers and interposed between the sheets of panel material 4*a* and 4*b*. The bottom gusset portion 3 is formed by a sheet of bottom gusset material 6 which is interposed between the sheets of panel material 4*a* and 4*b*.

In the plastic bag, one of the sheets of panel material 4*a* is superposed on the other sheet of panel material 4*b* which is folded along a widthwise folded line 7 so that a folded portion can be formed in the other sheet of panel material 4*b*. The sheet of bottom gusset material 6 is formed by the folded portion. The sheet of bottom gusset material 6 is folded along a widthwise folded line 8 and into halves, superposed into two layers and interposed between the sheets of panel material 4*a* and 4*b*.

The sheets of side gusset material 5 extend along the opposite side edges 9 of panel portions 1 while the sheet of bottom gusset material 6 extends along ones of the opposite end edges 10 of panel portions 1. In addition, the panel portions 1 and the side gusset portions 2 are heat sealed with each other along the opposite side edges 9 of panel portions 1 so that heat seal lines 11 can be formed along the opposite side edges 9 of panel portions 1, as in the case of the plastic bag of U.S. Pat. No. 7,331,917. In addition, each of the sheets of side gusset material 5 has opposite end portions one of which is folded at an angle of 45°. One of the opposite end portions is folded into halves, superposed into two layers and interposed between the layers of the sheet of side gusset material 5 so that an auxiliary gusset portion 12 can be formed by one of the opposite end portions. The bottom gusset portion 3 is interposed between the layers of auxiliary gusset portion 12. The auxiliary gusset portions 12 and the bottom gusset portion 3 are heat sealed with each other along the opposite side edges 9 of panel portions 1 so that heat seal lines 11 can be formed along the opposite side edges 9 of the panel portions 1.

The plastic bag further includes an additional bottom gusset portion 13 in addition to the side gusset portions 2 and the bottom gusset portion 3, as in the case of the plastic bag of Japanese Patent Publication No. 4,108,846. The additional bottom gusset portion 13 is formed by a sheet of additional bottom gusset material 14 which is folded into halves, superposed into two layers and interposed between the sheets of panel material 4*a* and 4*b* to extend along the other end edges 15 of panel portions 1. In addition, the sheet of side gusset material 5 has the other end portion folded at an angle of 45°. The other end portion is folded into halves, superposed into two layers and interposed between the layers of the sheet of side gusset material 5 so that an auxiliary gusset portion 16 can be formed by the other end portion. The additional bottom gusset portion 13 is interposed between the layers of additional auxiliary gusset portion 16. The auxiliary gusset portions 16 and the additional bottom gusset portion 13 are heat sealed with each other along the opposite side edges 9 of panel portions 1 so that heat seal lines 11 can be formed along the opposite side edges 9 of panel portions 1. The panel portions 1 and the additional bottom gusset portion 13 are heat sealed with each other along the other end edges 15 of panel portions 1 so that heat seal lines 17 can be formed along the other end edges 15 of panel portions 1.

Furthermore, the plastic bag includes a bottom protrusion protruding from the bottom gusset portion 3. The bottom protrusion is provided with a handle hole 18 or zipper 19.

The plastic bag includes a first protrusion 20*a* as the bottom protrusion. In addition, the plastic bag includes a second protrusion 20*b* as the bottom protrusion. In this connection, it should be understood that the bottom gusset portion 3 has opposite side edges adjacent to ones of the opposite end edges 10 of panel portions 1. The first protrusion 20*a* is formed by one of the sheets of panel material 4*a* and the sheet of bottom gusset material 6 extending beyond and protruding from the bottom gusset portion 3 at one of the opposite side edges thereof to be opposed to and superposed on each other. The second protrusion 20*b* is formed by the other sheet of panel material 4*b* and the sheet of bottom gusset material 6 extending beyond and protruding from the bottom gusset portion 3 at the other side edge thereof to be opposed to and superposed on each other. The sheets of panel material 4*a* and 4*b* and the sheet of bottom gusset material 6 are heat sealed with each other along the opposite side edges 21 of first and second protrusions 20*a* and 20*b* so that heat seal lines 11 can be formed along the opposite side edges 21 of first and second protrusions 20*a* and 20*b*. The first protrusion 20*a* is provided with the handle hole 18 formed therein. The second protrusion 20*b* is also provided with the handle hole 18 formed therein.

In addition, the first protrusion 20*a* is provided with the zipper 19. The zipper 19 has been used generally in itself and interposed between one of the sheets of panel material 4*a* and the sheet of bottom gusset material 6 at the first protrusion 20*a*. The zipper 19 includes a male member formed integrally with a tape and fitted into a female member which is also formed integrally with a tape. One of the sheets of panel material 4*a* and the sheet of bottom gusset material 6 are heat sealed with the tapes of male and female members respectively so that heat seal lines 22 can be formed along the zipper 19. On the other hand, the other sheet of panel material 4*b* and the sheet of bottom gusset material 6 are heat sealed with each other along one of the opposite end edges 10 of panel portion 1 so that a heat seal line 23 can be formed along one of the opposite end edges 10 of panel portion 1.

The plastic bag is filled with content. In this connection, in order to make the panel portions 1 and the additional bottom gusset portion 13 heat sealed with each other along the other end edges 15 of panel portions 1, only one of the sheets of panel material 4*a* and the sheet of additional bottom gusset material 14 are heat sealed with each other when making the plastic bag, the other sheet of panel material 4*b* and the sheet of additional bottom gusset material 14 being not heat sealed with each other. The content passes between the other sheet of panel material 4*b* and the sheet of additional bottom gusset material 14 to be directed into the plastic bag after making the plastic bag. The other sheet of panel material 4*b* and the sheet of additional bottom gusset material 14 are then heat sealed with each other along the other end edge 15 of panel portion 1 after the plastic bag is filled with the content.

The plastic bag can therefore be enlarged by the side gusset portions 2 to obtain an increased capacity. A flat bottom surface can be formed by the additional bottom gusset portion 13 to make the plastic bag stand stably. The plastic bag can be shaped into a rectangular parallelepiped to have an appearance of box with a flat top surface formed by the bottom gusset portion 3, to be high in efficiency of being filled. The plastic bags can be piled up conveniently by making the first and second protrusions 20*a* and 20*b* folded along ones of the opposite end edges 10 of panel portions 1 to be superposed on the bottom gusset portion 3 after the plastic bag is filled with content.

In addition, the plastic bag includes the handle holes 18 formed in the first and second protrusions 20*a* and 20*b*. Any one can therefore make the first and second protrusions 20*a* and 20*b* close to each other to grasp and hold the first and second protrusions 20*a* and 20*b* and carry the plastic bag by the handle holes 18 by hand. The plastic bag has an appearance and function of Boston bag to be preferable.

Furthermore, any one can open the plastic bag by the zipper 19 for taking out the content and then close the plastic bag by the zipper 19.

In the plastic bag of FIG. 1, not only one of the sheets of panel material 4*a* and the sheet of additional bottom gusset material 14 but also the other sheet of panel material 4*b* and the sheet of additional gusset material 14 may be heat sealed with each other when making the plastic bag. It is practicable to open the plastic bag by the zipper 19 to make content pass between one of the sheets of panel material 4*a* and the sheet of bottom gusset material 6 to be directed into the plastic bag, then closing the plastic bag by the zipper 19 after the plastic bag is filled with the content.

The sheet of bottom gusset material 6 has not always to be formed by the folded portion of the other sheet of panel material 4*b*. The sheet of bottom gusset material 6 may comprise a sheet different from the sheets of panel material 4*a* and 4*b*. In this case, the other sheet of panel material 4*b* and the sheet of bottom gusset material 6 are not heat sealed with each other at the second protrusion 20*b* when making the plastic bag to make content pass between the other sheet of panel material 4*b* and the sheet of bottom gusset material 6 to be directed to the plastic bag when the plastic bag is filled with content and after making the plastic bag. The other sheet of panel material 4*b* and the sheet of bottom gusset material 6 are then heat sealed with each other to make the heat seal line 23 formed.

Figure 4:
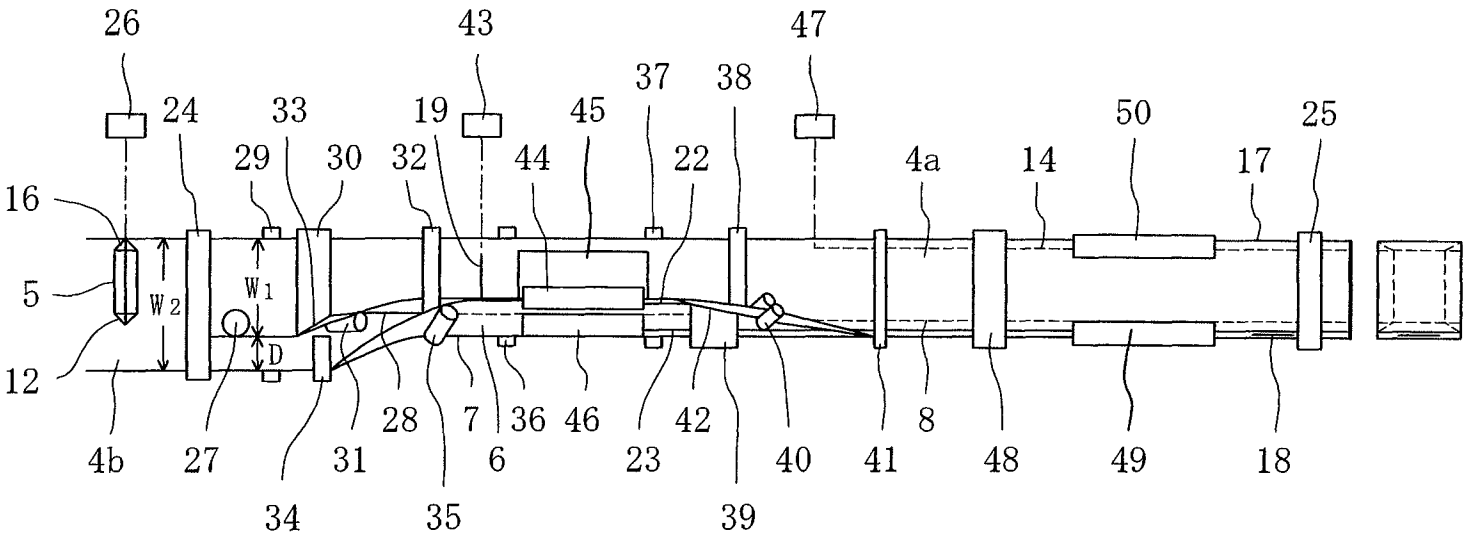
FIG. 4 is a plan view of a preferred embodiment of the invention.

FIG. 4 illustrates an apparatus according to the invention, constituting a preferred embodiment of the invention and arranged to successively make plastic bags of FIG. 1.

Figure 6:
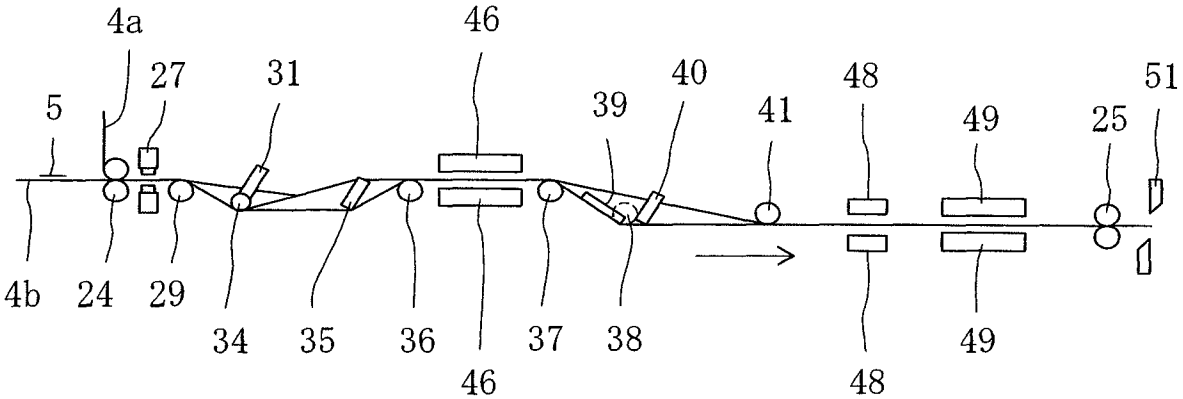
FIG. 6 is a side view of the apparatus of FIG. 4.

The apparatus includes panel portions forming means by which two webs of panel material 4*a* and 4*b* are opposed to and superposed on each other and fed longitudinally thereof, the panel portions 1 being formed by the webs of panel material 4*a* and 4*b*. The panel portions forming means comprises panel material feeding means including feed rollers 24 and 25. The webs of panel material 4*a* and 4*b* are directed to the feed rollers 24 to be opposed to and superposed on each other, as shown in FIG. 6. The webs of panel material 4*a* and 4*b* are then directed to the feed roller 25. The feed rollers 24 and 25 are driven by a drive motor so that the webs of panel material 4*a* and 4*b* can be fed longitudinally thereof by the feed rollers 24 and 25. In the embodiment, the webs of panel material 4*a* and 4*b* are fed intermittently for a length.

The apparatus further includes side gusset portions forming means by which sheets of side gusset material 5 are folded into halves and combined with and interposed between the webs of panel material 4*a* and 4*b* to extend widthwise thereof, the side gusset portions 2 being formed by the sheets of side gusset material 5. The side gusset portions forming means comprises side gusset material supply means 26 by which the sheets of side gusset material 5 are folded previously and into halves. In the embodiment, each of the sheets of side gusset material 5 has a double width, which is folded into halves on the opposite sides of the longitudinal centerline to be superposed into two layers, as in the case of the apparatus of U.S. Pat. No. 7,3331,917. In addition, the sheet of side gusset material 5 includes opposite end portions one of which is folded at an angle of 45° so that an auxiliary gusset portion 12 can be formed by one of the opposite end portions. The other end portion is also folded at an angle of 45° so that an auxiliary gusset portion 16 can be formed by the other end portion. The sheets of side gusset material 5 are then supplied to the webs of panel material 4*a* and 4*b* one by one whenever the webs of panel material 4*a* and 4*b* are fed intermittently, to be interposed between the webs of panel material 4*a* and 4*b*. The webs of panel material 4*a* and 4*b* and the sheet of side gusset material 5 are then heat sealed or ultrasonic sealed with each other by heat seal or ultrasonic seal means 27 at the position of one of the opposite end portions of the sheet of side gusset material 5 whenever the webs of panel material 4*a* and 4*b* are fed intermittently, as also in the case of the apparatus of the U.S. patent.

The apparatus further includes panel material guide means by which one of the webs of panel material 4*a* is guided to be folded along a longitudinal folded line 28 when being fed to open the webs of panel material 4*a* and 4*b* and form an open surface thereof. The panel material guide means includes a guide roller 29, a guide plate 30 and guide rollers 31 and 32, the webs of panel material 4*a* and 4*b* passing through the guide roller 29 to be directed to the guide plate 30. The guide plate 30 includes an inclined edge 33 with which one of the webs of panel material 4*a* is engaged. In addition, one of the webs of panel material 4*a* is directed to the guide roller 31 and guided by the inclined edge 33 and the guide roller 31 to be folded upwardly and vertically. The webs of panel material 4*a* and 4*b* are then directed to the guide roller 32 so that one of the webs of panel material 4*a* can be guided by the guide roller 32 to be folded completely, to open the webs of panel material 4*a* and 4*b* and form the open surface thereof, as also in the case of the apparatus of the U.S. patent.

In addition, the apparatus includes bottom gusset portion forming means by which a web of bottom gusset material 6 is combined with the webs of panel material 4*a* and 4*b* to extend longitudinally thereof, the bottom gusset portion 3 being formed by the web of bottom gusset material 6. The bottom gusset portion forming means comprises additional panel material guide means by which the other web of panel material 4*b* is guided to be folded along a longitudinal folded line 7 when being fed so that a folded portion can be formed in the other web of panel material 4*b*, the web of bottom gusset material 6 being formed by the folded portion and superposed on the open surface. It should be understood that the longitudinal folded line 7 would become the widthwise folded line 7 of FIG. 2. In this connection, one of the webs of panel material 4*a* has a small width W1 while the other web of panel material 4*b* has a large width W2. The other web of panel material 4*b* therefore protrudes beyond one of the webs of panel material 4*a* at a distance D. The additional panel material guide means comprises guide rollers 34, 35 and 36, the other web of panel material 4*b* passing through the guide roller 34 to be directed to the guide roller 35. The other web of panel material 4*b* is guided by the guide rollers 34 and 35 to be folded upwardly and vertically. The webs of panel material 4*a* and 4*b* are then directed to the guide roller 36 so that the other web of panel material 4*b* can be guided by the guide roller 36 to be folded completely. A folded portion can therefore be formed in the other web of panel material 4*b*, the web of bottom gusset material 6 being formed by the folded portion and superposed on the open surface, as also in the case of the apparatus of the U.S. patent.

One of the webs of panel material 4*a* is then unfolded to close the webs of panel material 4*a* and 4*b* by the panel material guide means after the web of bottom gusset material 6 is superposed on the open surface. The web of bottom gusset material 6 is folded into halves along a longitudinal folded line 8 and interposed between the webs of panel material 4*a* and 4*b*. The longitudinal folded line 8 would become the widthwise folded line 8 of FIG. 2. In the embodiment, the panel material guide means includes guide rollers 37 and 38, a guide plate 39, pinch rollers 40 and a guide roller 41, the webs of panel material 4*a* and 4*b* passing through the guide roller 37 to be directed to the guide roller 38 and the guide plate 39. The guide plate 39 includes an inclined edge 42 with which one of the webs of panel material 4*a* and the web of bottom gusset material 6 are engaged. One of the webs of panel material 4*a* and the web of bottom gusset material 6 are then directed to the pinch rollers 40 so that one of the webs of panel material 4*a* can be guided by the inclined edge 42, the guide roller 38 and the pinch rollers 40 to be unfolded upwardly and vertically. The web of bottom gusset material 6 is guided by the inclined edge 42, the guide roller 38 and the pinch rollers 40 to be folded upwardly and vertically. One of the webs of panel material 4*a* and the web of bottom gusset material 6 are then directed to the guide roller 41 so that one of the webs of panel material 4*a* can be guided by the guide roller 41 to be unfolded completely, closing the webs of panel material 4*a* and 4*b*. The web of bottom gusset material 6 is guided by the guide roller 41 to be folded completely and interposed between the webs of panel material 4*a* and 4*b*, as also in the case of the apparatus of the U.S. Patent.

The webs of panel material 4*a* and 4*b* can open the layers of the sheet of side gusset material 5 and the auxiliary gusset portion 12 and form an open surface thereof at one of the opposite end portions of the sheet of side gusset material 5 when one of the webs of panel material 4*a* is folded. The web of bottom gusset material 6 is superposed on the open surface. The webs of panel material 4*a* and 4*b* can then close the layers of the sheet of side gusset material 5 and the auxiliary gusset portion 12 when one of the webs 4*a* is unfolded so that the auxiliary gusset portion 12 can ride on the web of bottom gusset material 6, as also in the case of the apparatus of the U.S. Patent.

Figure 5:
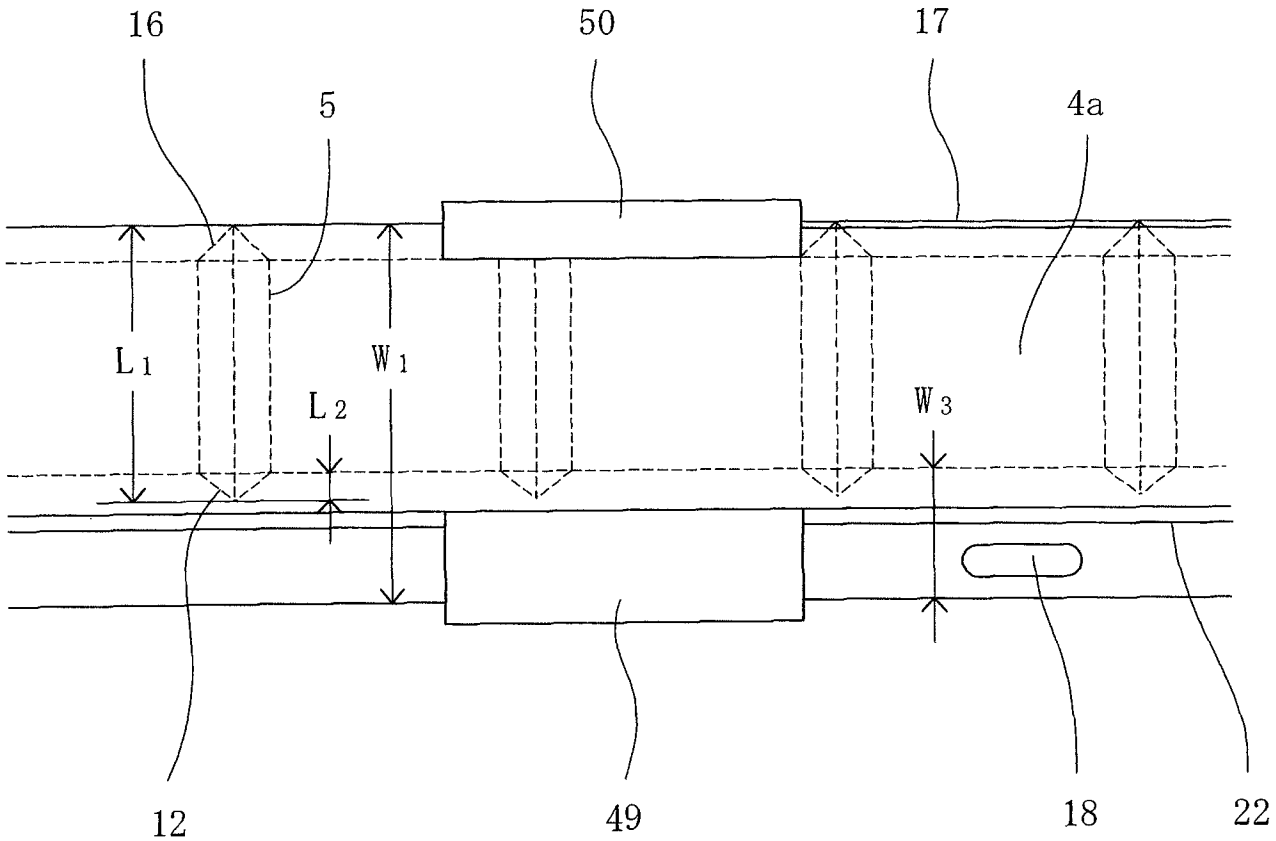
FIG. 5 is an enlarged view of one of the webs of panel material and the sheets of side gusset material of FIG. 4.

Furthermore, in the apparatus, the bottom gusset portion 3 is formed by the web of bottom gusset material 6 with at least one bottom protrusion 20*a* and 20*b* protruding from the bottom gusset portion 3 when the web of bottom gusset material 6 is superposed on the open surface. In the embodiment, one of the webs of panel material 4*a* has the small width W1 which is larger than the length L1 of the sheet of side gusset material 5, as shown in FIG. 5. The other web of panel material 4*b* has the large width W2, the web of bottom gusset material 6 being formed by the folded portion of the other web of panel material 4*b* and then folded into halves to have a width W3 which is larger than the length L2 of the auxiliary gusset portion 12. The first protrusion 20*a* is therefore formed as the bottom protrusion by one of the webs of panel material 4*a* and the web of bottom gusset material 6 extending beyond and protruding from the bottom gusset portion 3 at one of the opposite side edges thereof to be opposed to and superposed on each other. The second protrusion 20*b* is formed as the bottom protrusion by the other web of panel material 4*b* and the web of bottom gusset material 6 extending beyond and protruding from the bottom gusset portion 3 at the other side edge thereof to be opposed to and superposed on each other.

The apparatus further includes zipper supply means 43 as option means by which the first protrusion 20*a* is provided with the zipper 19. The zipper 19 is fed by the zipper supply means 43 and supplied to the webs of panel material 4*a* and 4*b* when the web of bottom gusset material 6 is superposed on the open surface of the webs of panel material 4*a* and 4*b* after opening the webs of panel material 4*a* and 4*b* and forming the open surface thereof by the guide rollers 32, 35 and 36. The zipper 19 is interposed between one of the webs of panel material 4*a* and the web of bottom gusset material 6 to extend longitudinally of the webs of panel material 4*a* and 4*b*. The zipper 19 comprises a longitudinal continuity and includes the male member fitted into the female member. One of the webs of panel material 4*a* and the web of bottom gusset material 6 are opposed to the tapes of the male and female members. The apparatus further includes zipper seal means 44 as longitudinal seal means disposed between the guide rollers 36 and 37 of the webs of panel material 4*a* and 4*b*. The web of bottom gusset material 6 and the tape are heat sealed with each other while the web of panel material 4*a* and the tape are heat sealed with each other longitudinally of the webs of panel material 4*a* and 4*b* by the zipper seal means 44 whenever the webs of panel material 4*a* and 4*b* are fed intermittently. For example, a plate 45 is interposed between the layers of the web of panel material 4*a* which is folded along the longitudinal folded line 28. The web of bottom gusset material 6, the tapes and the web of panel material 4*a* are sandwiched between the zipper seal means 44 and the plate 45 so that the web of bottom gusset material 6 and the tape can be heat sealed with each other while the web of panel material 4*a* and the tape can be heat sealed with each other, heat seal lines 22 being formed along the zipper 19. It should therefore be understood that the web of panel material 4*a* and the web of bottom gusset material 6 are heat sealed with each other through the tapes of the zipper 19. Accordingly, the first protrusion 20*a* is provided with the zipper 19.

The apparatus further includes longitudinal seal means 46 disposed between the guide rollers 36 and 37 of the webs of panel material 4*a* and 4*b*. The other web of panel material 4*b* and the web of bottom gusset material 6 are heat sealed with each other longitudinally of the webs of panel material 4*a* and 4*b* by the longitudinal seal means 46 whenever the webs of panel material 4*a* and 4*b* are fed intermittently so that a heat seal line 23 can be formed. The heat seal line 23 would become the heat seal line 23 of FIG. 3. The apparatus further includes additional bottom gusset material supply means 47 by which a web of additional bottom gusset material 14 is folded into halves and supplied to the webs of panel material 4*a* and 4*b* at a position between the guide rollers 38 and 41 of the webs of panel material 4*a* and 4*b*. The web of additional bottom gusset material 14 is interposed between the webs of panel material 4*a* and 4*b* to extend longitudinally of the webs of panel material 4*a* and 4*b* after being supplied. In addition, the auxiliary gusset portion 16 rides on the web of additional bottom gusset material 14 at the other end portion of the sheet of side gusset material 5.

The apparatus further includes cross seal means 48 by which the webs of panel material 4*a* and 4*b* and the sheet of side gusset material 5 are heat sealed with each other widthwise of the webs of panel material 4*a* and 4*b* whenever the webs of panel material 4*a* and 4*b* are fed intermittently so that the heat seal line 11 can be formed.

The apparatus further includes a punch 49 as option means by which the webs of panel material 4*a* and 4*b* and the web of bottom gusset material 6 are punched out to form handle holes 18 therein at the first and second protrusions 20*a* and 20*b* after being heat sealed and whenever the webs of panel material 4*a* and 4*b* are fed intermittently. The first and second protrusions 20*a* and 20*b* are therefore provided with the handle holes 18. The apparatus further includes longitudinal seal means 50 by which the webs of panel material 4*a* and 4*b* and the web of additional bottom gusset material 14 are heat sealed with each other longitudinally of the webs of panel material 4*a* and 4*b* so that the heat seal lines 17 can be formed.

The apparatus further include a cutter 51 by which the webs of panel material 4*a* and 4*b*, the sheet of side gusset material 5, the web of bottom gusset material 6 and the web of additional bottom gusset material 14 are cut widthwise of the webs of panel material 4*a* and 4*b* whenever the webs of panel material 4*a* and 4*b* are fed intermittently. They are cut along the longitudinal centerline of the web of side gusset material 5. The webs of panel material 4*a* and 4*b*, the web of bottom gusset material 6 and the web of additional bottom gusset material 14 are cut into the sheets of panel material 4*a* and 4*b*, the sheet of bottom gusset material 6 and the sheet of additional bottom gusset material 14 of FIG. 2.

The apparatus can therefore successively make the plastic bags of FIG. 1.

It should be understood that in the apparatus, one of the webs of panel material 4*a* is unfolded to close the webs of panel material 4*a* and 4*b* by the panel material guide means after the web of bottom gusset material 6 is superposed on the open surface. The web of bottom gusset material 6 is folded into halves along the longitudinal folded line 8 and interposed between the webs of panel material 4*a* and 4*b*. The webs of panel material 4*a* and 4*b* and the sheet of side gusset material 5 are then heat sealed with each other widthwise of the webs of panel material 4*a* and 4*b* under a condition of closing the webs of panel material 4*a* and 4*b*. The webs of panel material 4*a* and 4*b*, the sheet of side gusset material 5 and the web of bottom gusset material 6 are cut widthwise of webs of panel material 4*a* and 4*b* under the condition of closing the webs of panel material 4*a* and 4*b*.

In this connection, the webs of panel material 4*a* and 4*b* and the sheet of side gusset material 5 may be heat sealed with each other widthwise of the webs of panel material 4*a* and 4*b* under a condition of opening the webs of panel material 4*a* and 4*b*. The webs of panel material 4*a* and 4*b*, the sheet of side gusset material 5 and the web of bottom gusset material 6 may be cut widthwise of the webs of panel material 4*a* and 4*b* under the condition of opening the webs of panel material 4*a* and 4*b*. In this case, the webs of panel material 4*a* and 4*b* should be directed to the cross seal means 48 and the cutter 51 without making one of the webs of panel material 4*a* unfolded to close the webs of panel material 4*a* and 4*b*.

The web of bottom gusset material 6 may comprise a web different from the webs of panel material 4*a* and 4*b*. In this case, the bottom gusset portion forming means comprises not the additional guide means but bottom gusset material supply mean by which the web of bottom gusset material 6 is supplied to the webs of panel material 4*a* and 4*b* and superposed on the open surface.

Figure 7:
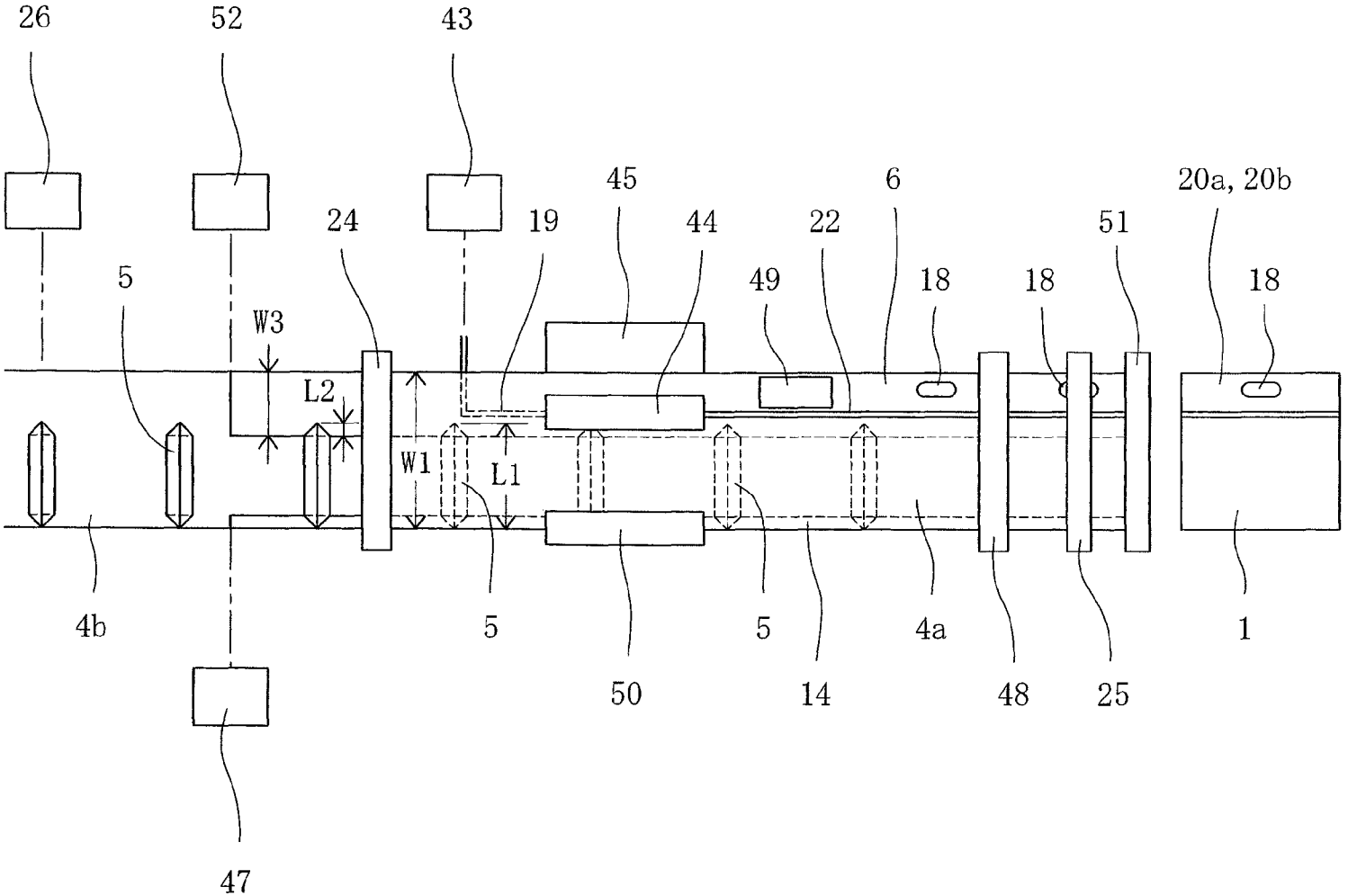
FIG. 7 is a plan view of another embodiment.

FIG. 7 illustrates an apparatus according to the invention, constituting another embodiment of the invention.

Figure 8:
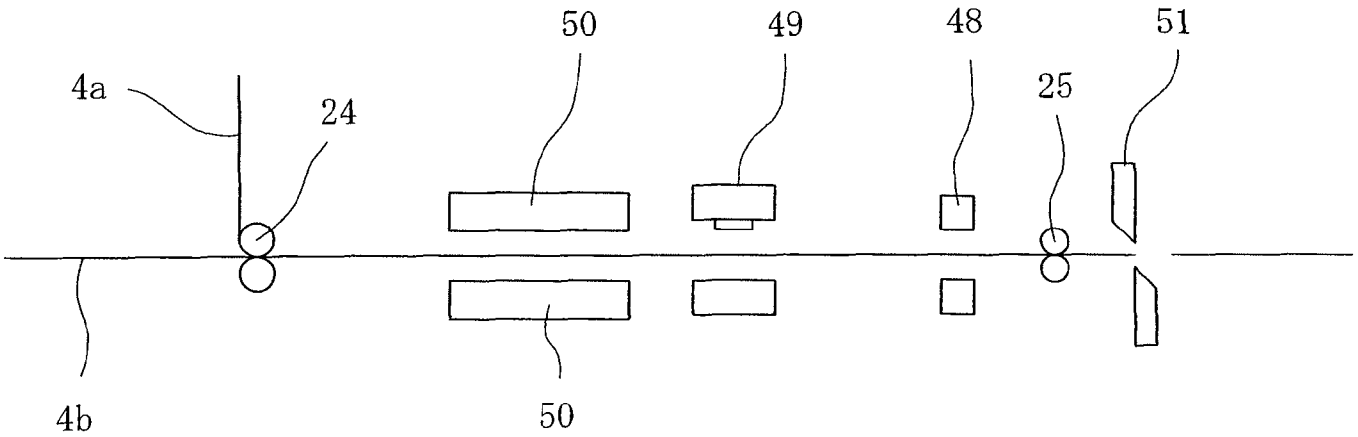
FIG. 8 is a side view of the apparatus (A) and a side view of the heat seal means (B) of FIG. 7.
Figure 8:
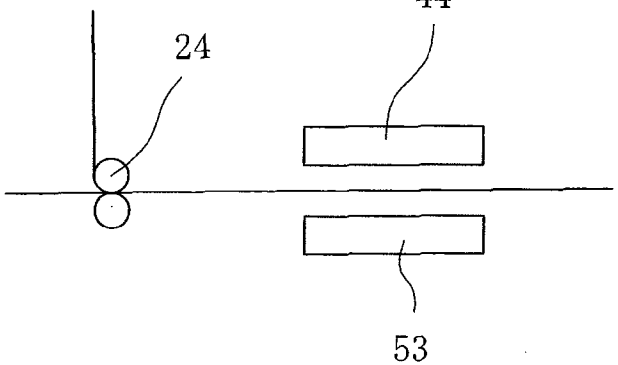

The apparatus includes the feed rollers 24 and 25 driven by the drive motor so that the webs of panel material 4*a* and 4*b* can be fed longitudinally thereof by the feed rollers 24 and 25, as shown in FIG. 8 and as in the case of the apparatus of FIG. 4. The webs of panel material 4*a* and 4*b* are fed intermittently for a length.

The apparatus further includes the side gusset material supply means 26 by which the sheets of side gusset material 5 are folded into halves and then supplied to the webs of panel material 4*a* and 4*b* one by one whenever the webs of panel material 4*a* and 4*b* are fed intermittently, as also in the case of the apparatus of FIG. 4.

The apparatus further includes the bottom gusset portion forming means which comprises bottom gusset material supply means 52 by which the web of bottom gusset material 6 is folded into halves and supplied to and interposed between the webs of panel material 4*a* and 4*b*. The web of bottom gusset material 6 has the width W3 which is larger than the length L2 of the auxiliary gusset portion 12 when being folded into halves, as also in the case of the case of the apparatus of FIG. 4. The auxiliary gusset portion 12 rides on the web of bottom gusset material 6.

The apparatus further includes the additional bottom gusset supply means 47 by which the web of additional bottom gusset material 14 is folded into halves, supplied to and interposed between the webs of panel material 4*a* and 4*b*, as also in the case of the apparatus of FIG. 4. The auxiliary gusset portion 16 rides on the web of additional bottom gusset material 16.

Figure 9:
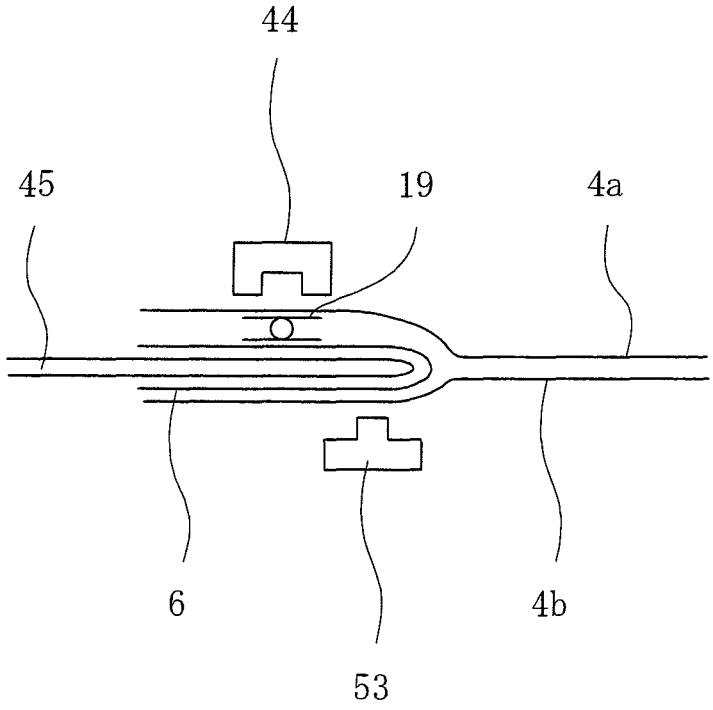
FIG. 9 is a sectional view of the heat seal means of FIG. 8.

The apparatus further includes the zipper supply means 43 by which the zipper 19 is supplied to the webs of panel material 4*a* and 4*b* and interposed between one of the webs of panel material 4*a* and the web of bottom gusset material 6. The web of panel material 4*a*, the tapes and the web of bottom gusset material 6 are then heat sealed with each other by the zipper seal means 44 and the plate 45, as also in the case of the apparatus of FIG. 4. In addition, the web of panel material 4*b* and the web of bottom gusset material 6 are heat sealed with each other longitudinally of the webs of panel material 4*a* and 4*b* by longitudinal seal means 53 and the plate 45, as shown in FIG. 9.

The apparatus further includes the longitudinal seal means 50 by which the webs of panel material 4*a* and 4*b* and the web of additional bottom gusset material 14 are heat sealed with each other. The apparatus further includes the punch 49 by which the webs of panel material 4*a* and 4*b* and the web of bottom gusset material 6 are punched out to form the handle holes 18 therein, as also in the case of the apparatus of FIG. 4.

The webs of panel material 4*a* and 4*b*, the sheet of side gusset material 5, the web of bottom gusset material 6 and the web of additional bottom gusset material 14 are then cut widthwise of the webs of panel material 4*a* and 4*b* by the cutter 51.

The apparatus can therefore successively make the plastic bags of FIG. 1.

Figure 10:
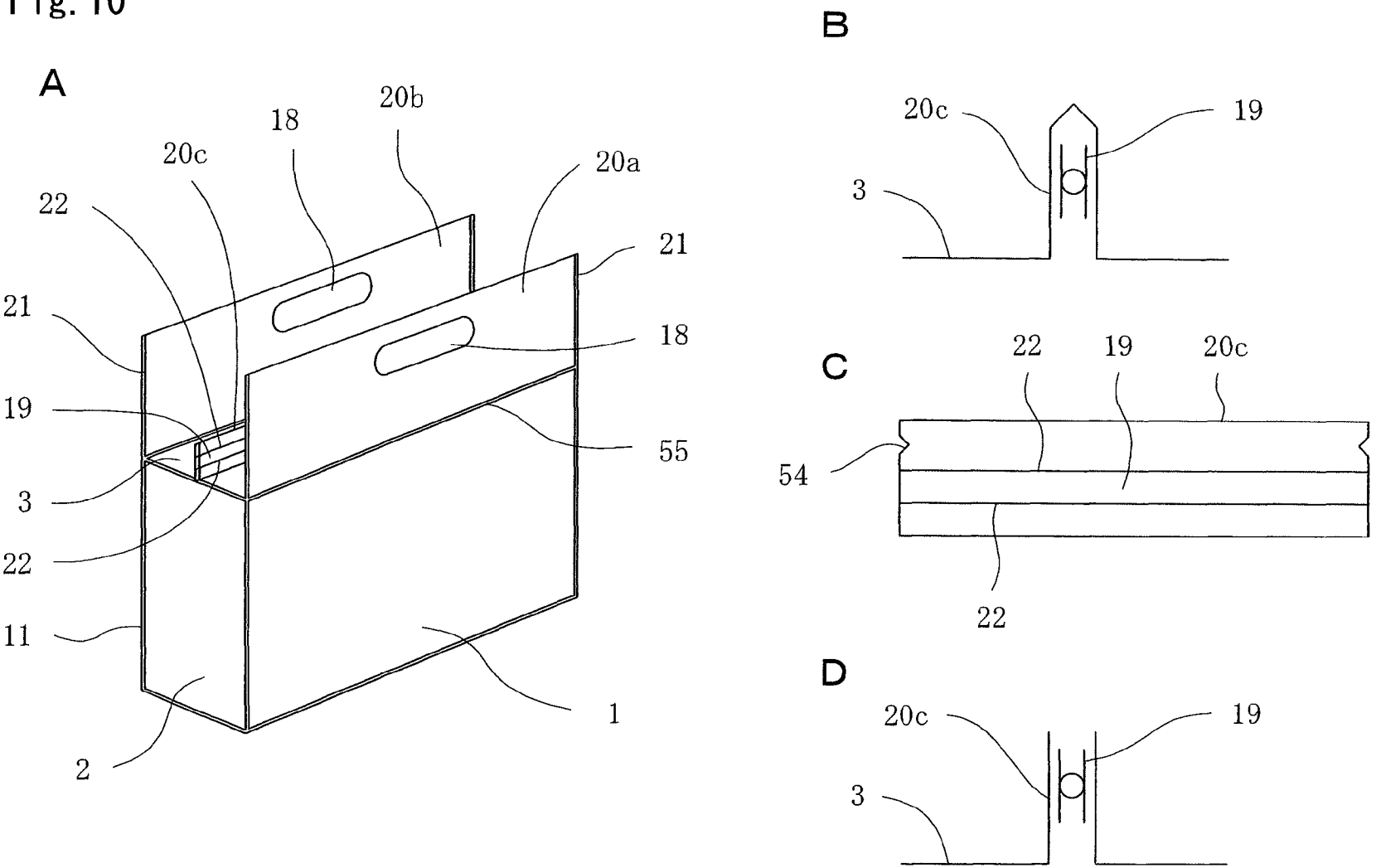
FIG. 10 is a perspective view of another plastic bag (A), a sectional view of the third protrusion (B), an elevational view of the third protrusion (C) and a sectional view of the third protrusion (D).

FIG. 10 illustrates another plastic bag. The plastic bag includes the first and second protrusions 20*a* and 20*b* formed by the sheets of panel material and the sheet of bottom gusset material extending beyond and protruding from the bottom gusset portion 3 at the opposite side edges thereof to be opposed to and superposed on each other. The sheets of panel material and the sheet of bottom gusset material are heat sealed with each other along the opposite side edges 21 of first and second protrusions 20*a* and 20*b*. The first and second protrusions 20*a* and 20*b* are provided with the handle holes 18, as in the case of the plastic bag of FIG. 1.

However, the plastic bag includes a third protrusion 20*c* as the bottom protrusion in addition to the first and second protrusions 20*a* and 20*b*. The third protrusion 20*c* is formed by the sheet of bottom gusset material folded and superposed into two layers, extending beyond and protruding from the bottom gusset portion 3 between the opposite side edges thereof. The third protrusion 20*c* extends parallel to the opposite side edges of the bottom gusset portion 3. In addition, not the first protrusion 20*a* but the third protrusion 20*c* is provided with the zipper 19. The zipper 19 is interposed between the layers of the sheet of bottom gusset material. The sheet of bottom gusset material is heat sealed with the tapes of male and female member so that heat sealed lines 22 can be formed along the zipper 19. Furthermore, a notch 54 is formed in the third protrusion 20*c* at one of the opposite side edges thereof. Notches may be formed in the third protrusion 20*c* at the opposite side edges thereof.

Any one can therefore tear off the third protrusion 20*c* by the notch 54 and along the zipper 19. He can then open the plastic bag by the zipper 19 for taking out content and then close the plastic bag by the zipper 19.

The third protrusion 20*c* may have an open edge (FIG. 10D). In this case, the notch 54 has not to be formed in the third protrusion 20*c*.

In the plastic bag, the panel portions 1 and the bottom gusset portion 3 are heat sealed with each other along ones of the opposite end edges of panel portions 1 so that heat sealed lines 55 can be formed along ones of the opposite end edges of panel portions 1.

In order to successively make plastic bags of FIG. 10, the apparatus should include bottom gusset material guide means by which the web of bottom gusset material is guided to be folded between the opposite side edges of the web of bottom gusset material when the webs of panel material are fed and the web of bottom gusset material is superposed on the open surface so that the third protrusion 20*c* can be formed by the web of bottom gusset material. The zipper 19 is supplied to the web of bottom gusset material and interposed between the layers thereof at the third protrusion 20*c*. The web of bottom gusset material and the zipper 19 are then heat sealed with each other at the third protrusion 20*c* by zipper seal means whenever the webs of panel material are fed intermittently. The third protrusion 20*a* is therefore provided with the zipper 19. The third protrusion 20*c* may be formed previously before the web of bottom gusset material is superposed on the open surface. The zipper 19 may be interposed between the layers of the web of bottom gusset material at the third protrusion 20*c* before the web of bottom gusset material is superposed on the open surface. The web of bottom gusset material and the zipper 19 may be heat sealed with each other before the web of bottom gusset material is superposed on the open surface.

Figure 11:
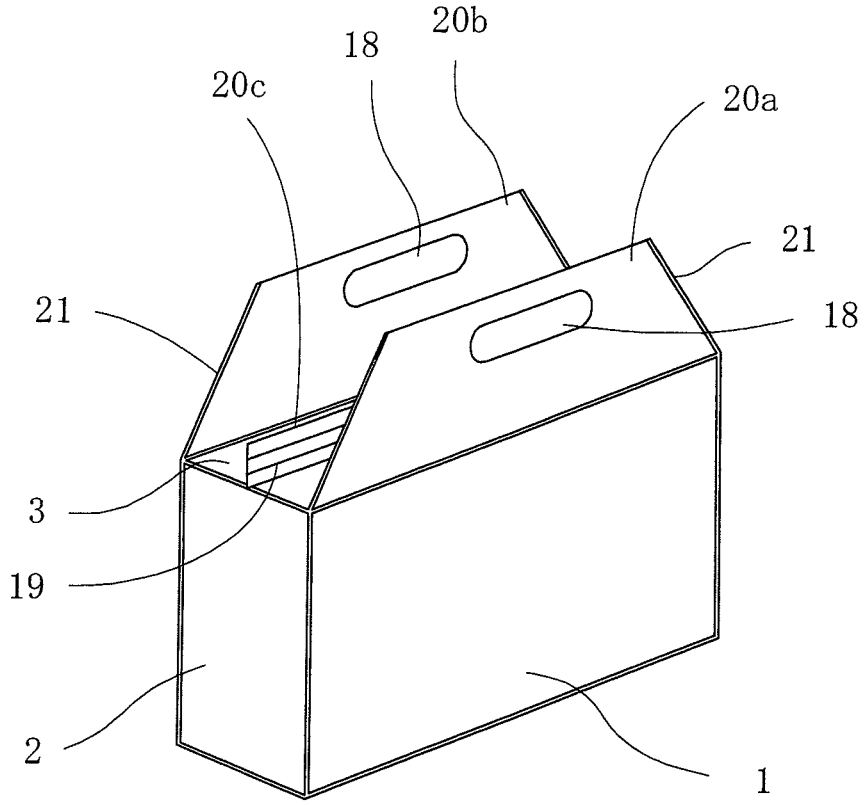
FIG. 11 is a perspective view of another plastic bag.

The first and second protrusions 20*a* and 20*b* may include opposite side edges 21 inclined to have an appearance of trapezoid, as shown in FIG. 11. The sheets of panel material and the sheet of bottom gusset material may be heat sealed with each other along the opposite side edges 21. The sheets of panel material and the sheet of bottom gusset material may be heat cut to be joined to each other along the opposite side edges 21.

In order to successively make the plastic bags of FIG. 11, the apparatus should include Thomson blades by which the webs of panel material and the web of bottom gusset material are cut along the opposite side edges 21 of the first and second protrusions 20*a* and 20*b* whenever the webs of panel material are fed intermittently to make the opposite side edges 21 inclined. The webs of panel material and the web of bottom gusset material are then heat sealed with each other along the opposite side edges 21 by heat seal means. The webs of panel material and the web of bottom gusset material may be heat cut by heat cut means.

Figure 12:
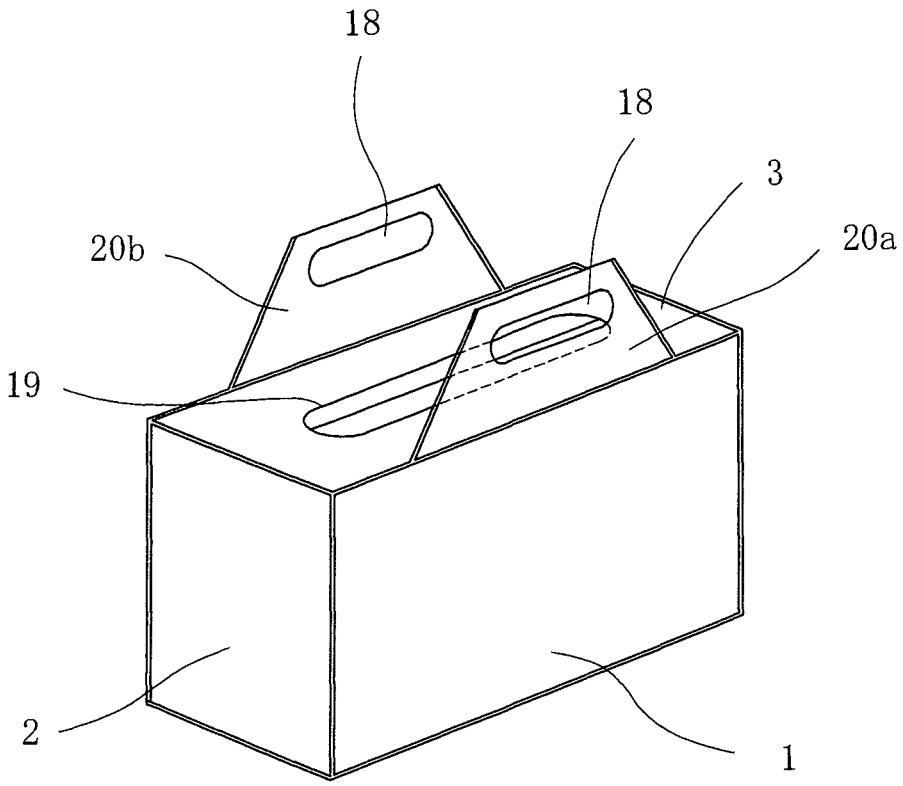
FIG. 12 is a perspective view of another plastic bag.

The first and second protrusions 20*a* and 20*b* may be spaced from the side gusset portions 2, as shown in FIG. 12. The bottom gusset portion 3 may be provided with the zipper 19 between the opposite side edges of the bottom gusset portion 3. The zipper 19 extends parallel to the opposite side edges of the bottom gusset portion 3.

Figure 13:
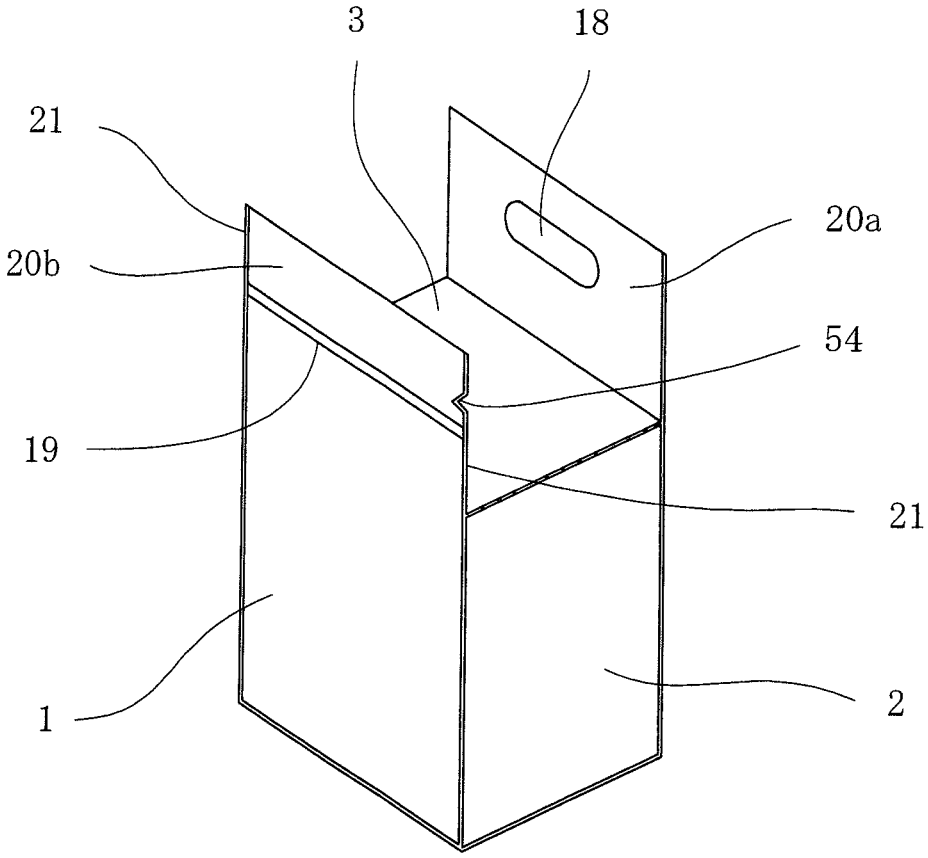
FIG. 13 is a perspective view of another plastic bag.

In a plastic bag of FIG. 13, the first protrusion 20*a* is provided with the handle hole 18. The second protrusion 20*b* is provided with the zipper 19. In addition, the second protrusion 20*b* is provided with a notch 54 formed therein at one of the opposite side edges 21 thereof above the zipper 19. The notch 54 may be formed in the second protrusion 20*b* at the opposite side edges 21 thereof.

Any one therefore can carry the plastic bag by the handle hole 18 after the plastic bag is filled with content. He can then tear off the second protrusion 20*b* by the notch 54 and open and close the plastic bag by the zipper 19. The plastic bags can be piled up conveniently by making the first and second protrusions 20*a* and 20*b* superposed on the bottom gusset portion 3.

Figure 14:
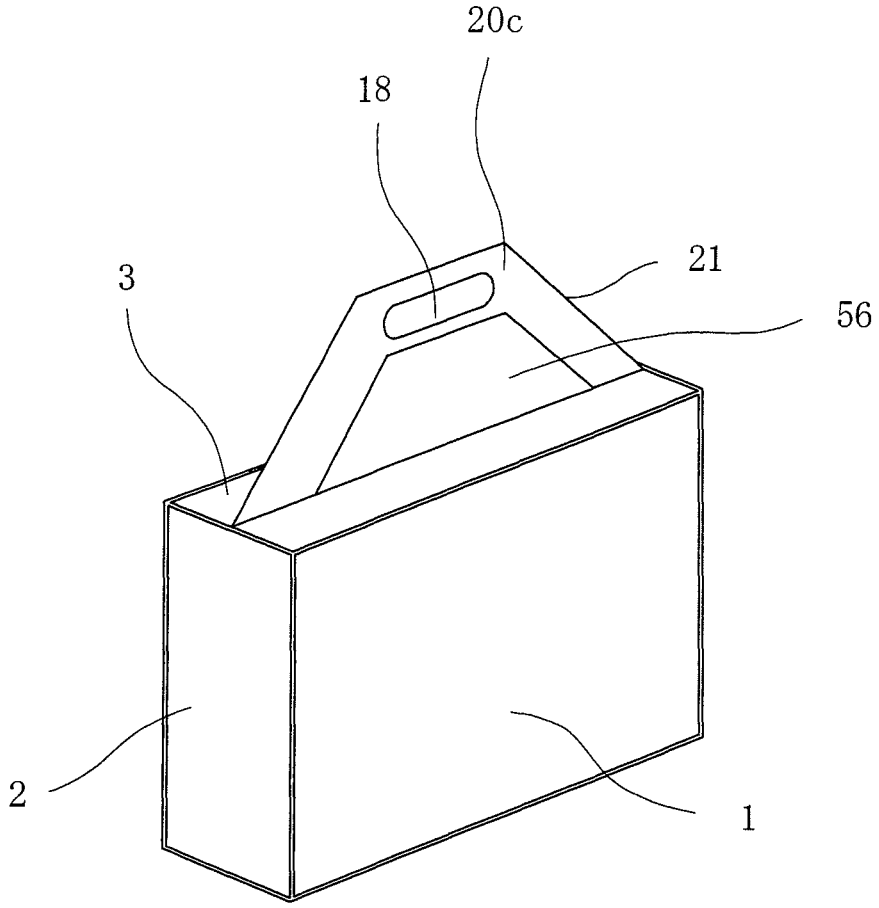
FIG. 14 is a perspective view of another plastic bag.

In a plastic bag of FIG. 14, the bottom protrusion comprises a single protrusion 20*c*. The single protrusion 20*c* is formed by the sheet of bottom gusset material folded and superposed into two layers, extending beyond and protruding from the bottom gusset portion 3 between the opposite side edges thereof, as in the case of the plastic bag of FIG. 10. The single protrusion 20*c* extends parallel to the opposite side edges of the bottom gusset portion 3. In addition, the single protrusion 20*c* is provided with the handle hole 18.

Furthermore, in the plastic bag of FIG. 14, the single protrusion 20*c* includes opposite side edges 21 inclined to have an appearance of trapezoid. The sheet of bottom gusset material is superposed into two layers which are heat sealed with each other along the opposite side edges 21 and the end edge of the single protrusion 20*c* so that a heat sealed portion can be formed along the opposite side edges 21 and the end edge, defining and closing an opening 56. In addition, the handle hole 18 is formed in the heat sealed portion adjacent the end edge. Any one can therefore open the opening 56 and pour content through the opening 56 by making the single protrusion 20*c* cut below the handle hole 18.

In order to successively make the plastic bags of FIG. 14, the apparatus should include Thomson blades by which the web of bottom gusset material is cut along the opposite side edges 21 of the single protrusion 20*c* whenever the webs of panel material are fed intermittently to make the opposite side edges 21 inclined. The layers of the web of bottom gusset material are then heat sealed with each other along the opposite side edges 21 and the end edge of the single protrusion 20*c* so that the single protrusion 20*c* can be provided with the opening 56. In addition, the web of bottom gusset material is punched out by the punch to make the handle hole 18 formed in the web of bottom gusset material whenever the webs of panel material are fed intermittently so that the single protrusion 20*c* can be provided with the handle hole 18.

Figure 15:
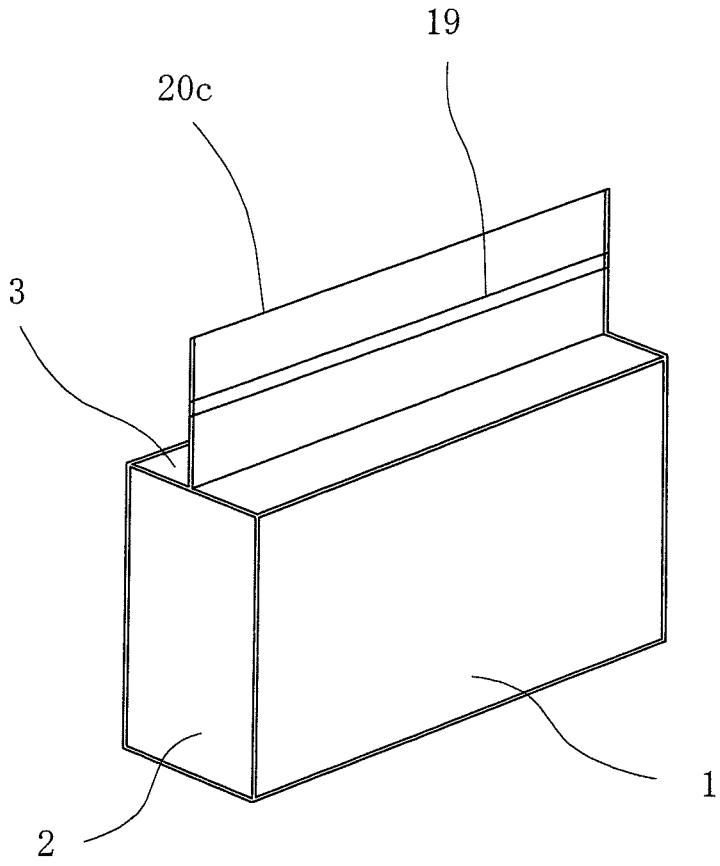
FIG. 15 is a perspective view of another plastic bag.

The single protrusion 20*c* may be provided with the zipper 19, as shown in FIG. 15.

Figure 16:
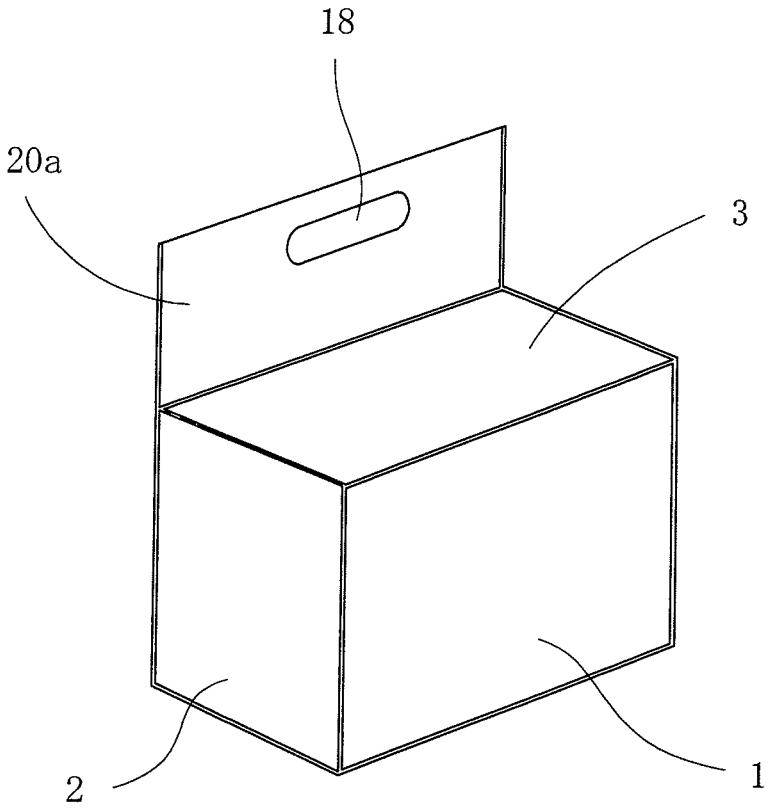
FIG. 16 is a perspective view of another plastic bag.

In a plastic bag of FIG. 16, the bottom protrusion comprises a single protrusion 20*a*. The single protrusion 20*a* is formed by one of the sheets of panel material and the sheet of bottom gusset material extending beyond and protruding from the bottom gusset material 3. The single protrusion 20*a* is provided with the handle hole 18.

Figure 17:
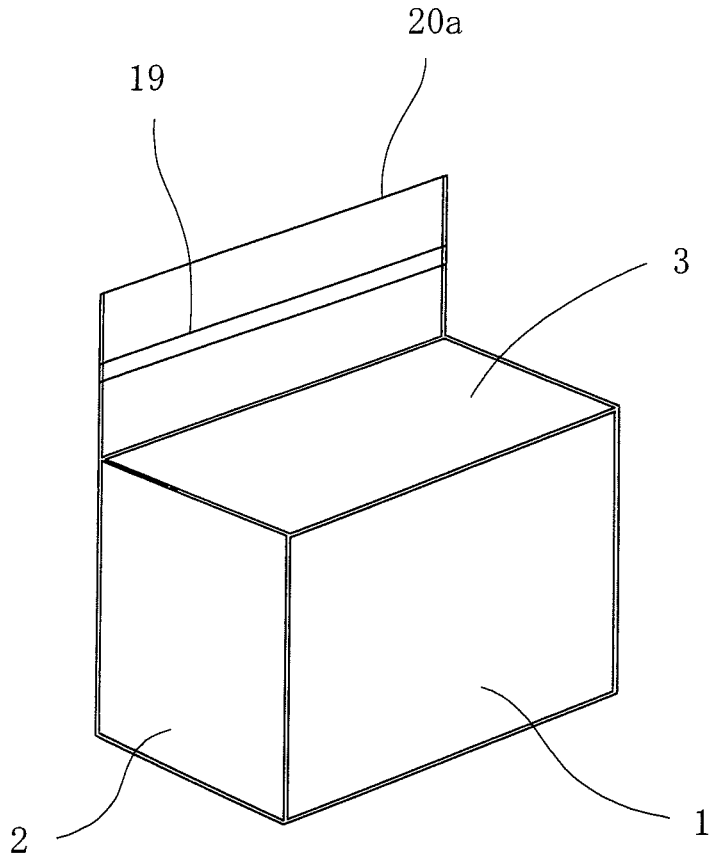
FIG. 17 is a perspective view of another plastic bag.

In a plastic bag of FIG. 17, the single protrusion 20*a* is provided with the zipper 19.

Figure 18:
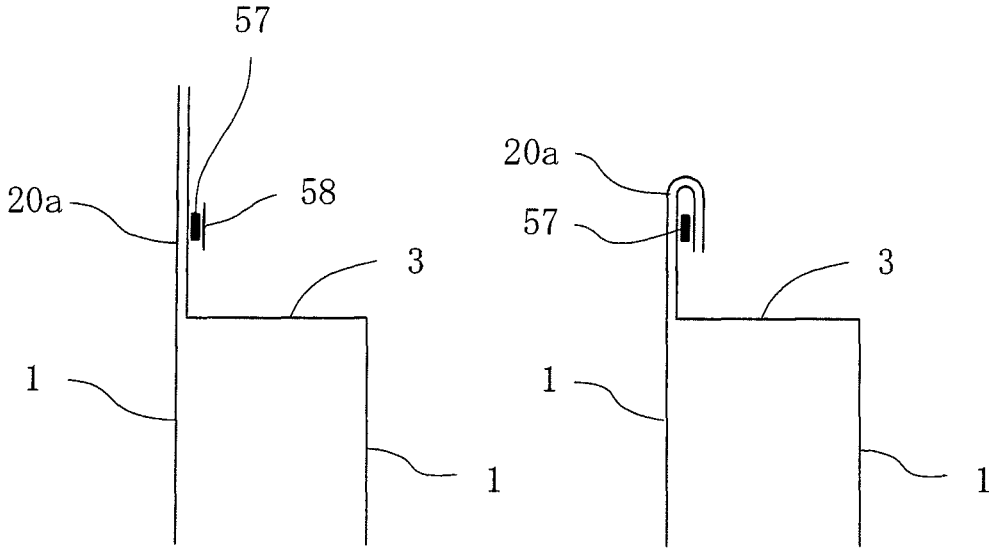
FIG. 18 is an explanatory view of another plastic bag.

In a plastic bag of FIG. 18, the single protrusion 20*a* is provided with adhesive means. The adhesive means comprises hot melt adhesive 57. In this connection, the single protrusion 20*a* includes an outer surface formed by one of the sheets of panel material extending beyond and protruding from the bottom gusset portion 3. The single protrusion 20*a* further includes an inner surface formed by the sheet of bottom gusset material extending beyond and protruding from the bottom gusset portion 3. The hot melt adhesive 57 is applied on the inner surface of the single protrusion 20*a*, a release paper 58 being put on the hot melt adhesive 57. The hot melt adhesive 57 and the release paper 58 are spaced from the end edge of the single protrusion 20*a* to extend horizontally. Any one can therefore close the plastic bag by making the release paper 58 removed from the hot melt adhesive 57, making the single protrusion 20*a* bent between the end edge of the single protrusion 20*a* and the hot melt adhesive 57 and making the end edge put on the hot melt adhesive 57. He can then open the plastic bag by making the end edge peeled from the hot melt adhesive 57. One of the sheets of panel material and the sheet of bottom gusset material may be heat sealed with each other at the end edge of the single protrusion 20*a*. In this case, one of the sheets of panel material and the sheet of bottom gusset material should be cut along the end edge when opening the plastic bag.

Figure 19:
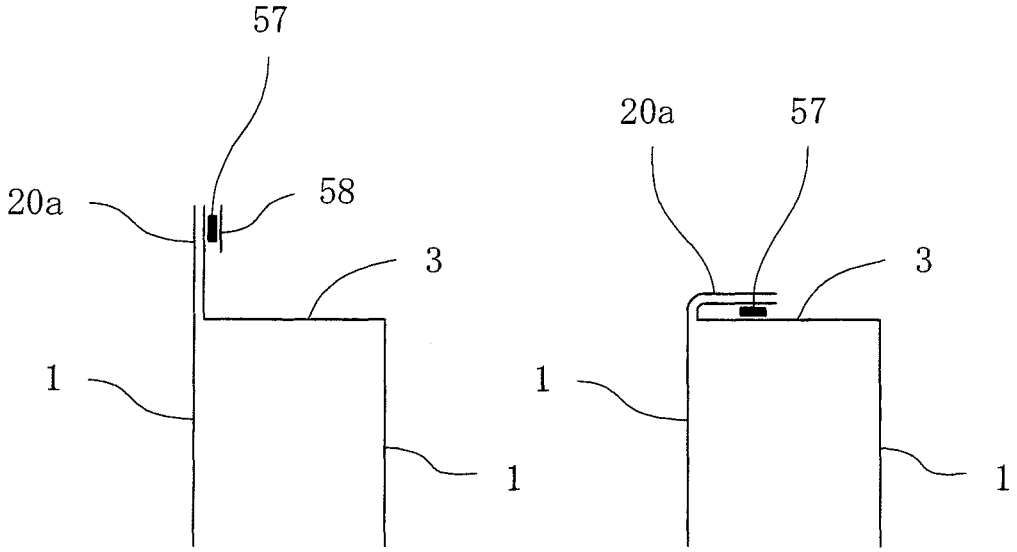
FIG. 19 is an explanatory view of another plastic bag.
Figure 20:
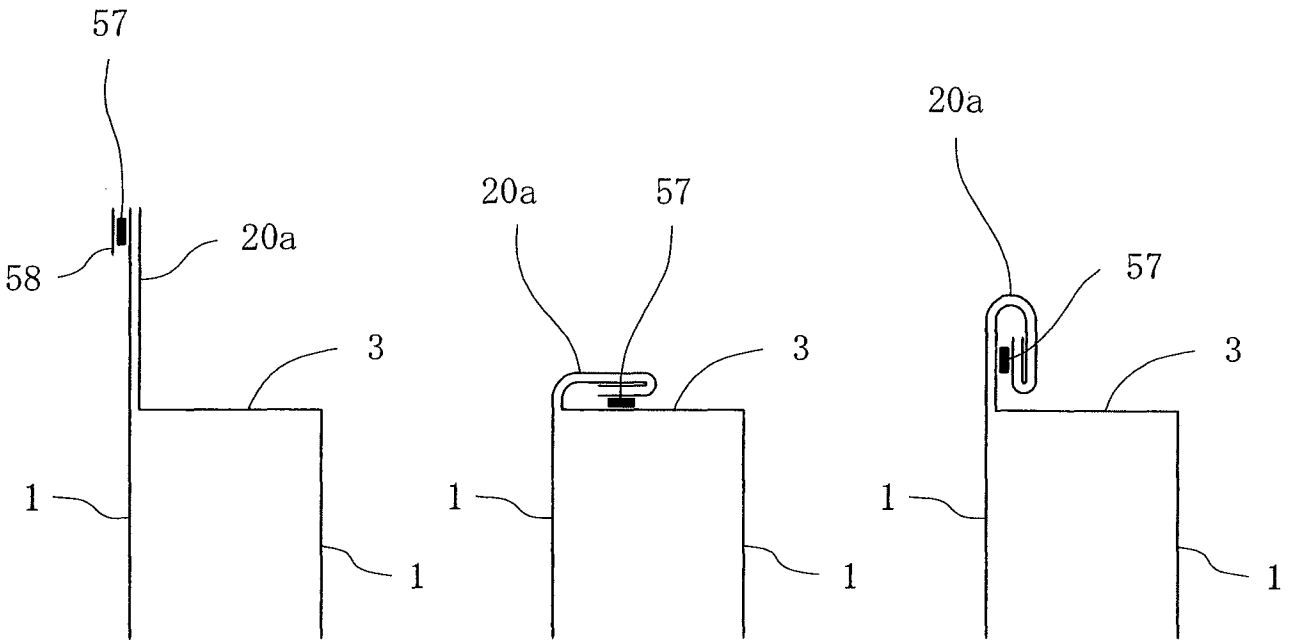
FIG. 20 is an explanatory view of another plastic bag.

The hot melt adhesive 57 and the release paler 58 may be positioned adjacent to the end edge of the single protrusion 20*a*, as shown in FIG. 19. The single protrusion 20*a* is bent toward the bottom gusset portion 3 so that the single protrusion 20*a* and the bottom gusset portion 3 can be stuck to each other with the hot melt adhesive 57. The hot melt adhesive 57 may be applied on the outer surface of the single protrusion 20*a* adjacent to the end edge thereof, the release paper 58 being put on the hot melt adhesive 57, as shown in FIG. 20. The single protrusion 20*a* is bent at a position below the hot melt adhesive 57 to make the hot melt adhesive 57 opposed to the bottom gusset potion 3 so that the single protrusion 20*a* and the bottom gusset portion 3 can be stuck to each other with the hot melt adhesive 57. The hot melt adhesive 57 may be opposed to the inner surface of the single protrusion 20*a* to make the outer and inner surfaces of the single protrusion 20*a* stuck to each other.

In order to successively make the plastic bags of FIG. 18, 19 or 20, the apparatus should include hot melt adhesive applying means as option means by which the hot melt adhesive 57 is applied on the inner or outer surface of the single protrusion 20*a* whenever the webs of panel material are fed intermittently so that the single protrusion 20*a* is provided with the hot melt adhesive 57, the release paper 58 being put on the hot melt adhesive 57.

The hot melt adhesive 57 may be applied on the bottom protrusion of any plastic bag. The adhesive means may comprise paste or two sided adhesive tape. In this case, the option means comprises adhesive means applying means by which paste or two sided adhesive tape is applied.

In each of the embodiments, the bottom protrusion may be formed by one of the webs of panel material or the web of bottom gusset material extending beyond and protruding from the bottom gusset portion.

What is claimed is:

1. An apparatus for successively making plastic bags each of which includes panel portions, side gusset portions and a bottom gusset portion, the apparatus comprising:

panel portions forming means by which two webs of panel material are opposed to and superposed on each other and fed longitudinally thereof, the panel portions being formed by the webs of panel material;

side gusset portions forming means by which sheets of side gusset material are folded into halves and combined with and interposed between the webs of panel material to extend widthwise thereof, the side gusset portions being formed by the sheets of side gusset material; and bottom gusset portion forming means by which a web of bottom gusset material is combined with the webs of panel material to extend longitudinally thereof, so that the bottom gusset portion is formed by the web of bottom gusset material, and at least one bottom protrusion is formed by one of the webs of panel material and the web of bottom gusset material extending beyond and protruding from the bottom gusset portion when the webs of panel material are fed longitudinally thereof, the apparatus being arranged to make the bottom protrusion provided with a handle hole, zipper, opening or adhesive means.

2. The apparatus as set forth in claim 1 further comprising:

panel material guide means by which one of the webs of panel material is guided to be folded along a longitudinal folded line when being fed to open the webs of panel material and form an open surface thereof, the web of bottom gusset material being superposed on the open surface.

3. The apparatus as set forth in claim 2 wherein the bottom gusset portion forming means comprises additional panel material guide means by which the other web of panel material is guided to be folded along a longitudinal folded line when being fed so that a folded portion can be formed in the other web of panel material, the web of bottom gusset material being formed by the folded portion and superposed on the open surface.

4. The apparatus as set forth in claim 2 wherein the bottom gusset portion forming means comprises bottom gusset material supply means by which the web of bottom gusset material is supplied to the webs of panel material and superposed on the open surface.

5. The apparatus as set forth in claim 2 wherein the webs of panel material are fed intermittently for a length.

6. The apparatus as set forth in claim 5 wherein the side gusset portions forming means comprises side gusset material supply means by which the sheets of side gusset material are supplied to the webs of panel material one by one whenever the webs of panel material are fed intermittently.

7. The apparatus as set forth in claim 5 further comprising:

longitudinally seal means by which the webs of panel material and the web of bottom gusset material are heat sealed with each other longitudinally of the webs of panel material whenever the webs of panel material are fed intermittently.

8. The apparatus as set forth in claim 5 further comprising:

cross seal means by which the webs of panel material and the sheet of side gusset material are heat sealed with each other widthwise of the webs of panel material whenever the webs of panel material are fed intermittently; and cutting means by which the webs of panel material, the sheet of side gusset material and the web of bottom gusset material are cut widthwise of the webs of panel material whenever the webs of panel material are fed intermittently.

9. The apparatus as set forth in claim 8 wherein one of the webs of panel material is unfolded to close the webs of panel material by the panel material guide means after the web of bottom gusset material is superposed on the open surface, the web of bottom gusset material being folded into halves along a longitudinal folded line and interposed between the webs of panel material, the webs of panel material and the sheet of side gusset material being then heat sealed with each other widthwise of the webs of panel material under a condition of closing the webs of panel material, the webs of panel material, the sheet of side gusset material and the web of bottom gusset material being cut widthwise of the webs of panel material under the condition of closing the webs of panel material.

10. The apparatus as set forth in claim 8 wherein the webs of panel material and the sheet of side gusset material are heat sealed with each other widthwise of the webs of panel material under a condition of opening the webs of panel material, the webs of panel material, the sheet of side gusset material and the web of bottom gusset material being cut widthwise of the webs of panel material under the condition of opening the webs of panel material.

11. The apparatus as set forth in claim 1 wherein the bottom gusset portion forming means comprises bottom gusset material supply means by which the web of bottom gusset material is folded into halves and supplied to and interposed between the webs of panel material.

12. An apparatus for successively making plastic bags each of which includes panel portions, side gusset portions and a bottom gusset portion, the apparatus comprising:

panel portions forming means by which two webs of panel material are opposed to and superposed on each other and fed longitudinally thereof, the panel portions being formed by the webs of panel material;

side gusset portions forming means by which sheets of side gusset material are folded into halves and combined with and interposed between the webs of panel material to extend widthwise thereof, the side gusset portions being formed by the sheets of side gusset material; and bottom gusset portion forming means by which a web of bottom gusset material is combined with the webs of panel material to extend longitudinally thereof so that the bottom gusset portion is formed by the web of bottom gusset material, and at least one bottom protrusion is formed by one of the webs of panel material or the web of bottom gusset material extending beyond and protruding from the bottom gusset portion when the webs of panel material are fed longitudinally thereof, the apparatus being arranged to make the bottom protrusion provided with a handle hole, zipper, opening or adhesive means.

* * * * *